US008100304B2

(12) United States Patent
Tanzini

(10) Patent No.: US 8,100,304 B2
(45) Date of Patent: Jan. 24, 2012

(54) METHOD AND APPARATUS FOR MULTI-POSITIONAL LOCKING HOLSTER

(76) Inventor: Philip J. Tanzini, Pomona, CA (US)

( * ) Notice: Subject to any disclaimer, the term of this patent is extended or adjusted under 35 U.S.C. 154(b) by 1076 days.

(21) Appl. No.: 11/073,152

(22) Filed: Mar. 4, 2005

(65) Prior Publication Data

US 2006/0196903 A1 Sep. 7, 2006

(51) Int. Cl.
*A01K 97/04* (2006.01)

(52) U.S. Cl. ..... 224/200; 224/197; 224/914

(58) Field of Classification Search ..... 224/197–200, 224/914, 185, 269, 660, 666, 282, 553, 904; 403/96
See application file for complete search history.

(56) References Cited

U.S. PATENT DOCUMENTS 5,364,137 A * 11/1994 Shimer ..... 297/327
5,568,922 A 10/1996 Siddle
5,690,552 A 11/1997 Siddle
6,056,643 A 5/2000 Wilmoth, III
6,059,157 A * 5/2000 Parsons et al. ..... 224/251
6,443,340 B1 * 9/2002 Chung et al. ..... 224/197
6,685,067 B2 * 2/2004 French ..... 224/198
2003/0000976 A1 * 1/2003 Malhotra ..... 224/197
2003/0085244 A1 * 5/2003 Parsons ..... 224/197
2006/0237495 A1 * 10/2006 Chen et al. ..... 224/197
2007/0023468 A1 * 2/2007 Ford ..... 224/197

* cited by examiner

*Primary Examiner* — Justin Larson
*Assistant Examiner* — Corey Skurdal
(74) *Attorney, Agent, or Firm* — Blakely, Sokoloff, Taylor & Zafman, LLP

(57) ABSTRACT

A device including a rotational locking piece. The rotational locking piece includes a first portion and a second portion. The first portion is rotationally connected to the second portion. The first portion can be locked in relation to the second portion by a locking device. The locking device includes a locking member having a locking portion. A holster is connected to the rotational locking device. The rotational locking piece locks the holster in a many positions and the locking portion prevents the first portion from rotating when it is inserted in a locking groove formed on the first portion.

15 Claims, 8 Drawing Sheets

METHOD AND APPARATUS FOR MULTI-POSITIONAL LOCKING HOLSTER

BACKGROUND

1. Field

The embodiments relate to utility belt device holders, and more particularly to a method and apparatus for multi-positional locking holster.

2. Description of the Related Art

For many years law enforcement officers, security officers and military police have been carrying holstered devices, such as batons, to protect and defend themselves or assist in apprehending violent suspects.

Holstered batons have evolved dramatically in the past 20 years. The baton began as a straight stick, also known as a billy club. The straight baton, however, became less effective and inconvenient due to the fact that they usually got left on a patrol car seat or swung and banged on an officer's leg during a foot pursuit. Straight batons were placed in a ring attached to a utility belt, which allowed the baton to swivel or rotate out of the way, if necessary. The problem with this design is that the baton can move in undesirable positions.

Side handle batons became popular in the late 1970s. These batons had the same inherent problem as the straight batons. In the early 1990s, expandable or telescopic batons became available in eliminating the problem with the baton banging on an officer's leg during foot pursuits. The expandable batons, however, present a different problem. Though the expandable baton adds convenience to officers, the expandable baton holster requires the expandable baton to sit higher in a holster than a non-expandable baton without the ability to rotate or pivot to a comfortable position. This causes the handle of the expandable baton to jab an officer in the ribs or abdomen, depending on where the holstered baton is placed on a duty belt. This is uncomfortable to an officer whenever sitting or driving. Of course, the placement of the holstered expandable baton must be made without sacrificing accessibility.

More recently, holsters have been designed to rotate by forcing a weapon from one resistive position to another using a friction type break free mechanism. The disadvantage to this is that it still allows the expandable baton to inadvertently switch from one position to another without the awareness of the officer. This is because either the friction resistance weakens over a period of time or that the holster is forced to move from actions, such as sitting in or exiting a vehicle. This not only becomes an inconvenience and nuisance to the officer, but it can be a significant safety issue. If the expandable baton holster is moved from the previously known position, the officer can lose costly seconds in the case of necessity for a rapid draw. These problems become significant safety risks.

SUMMARY

A device including a rotational locking piece. The rotational locking piece includes a first portion and a second portion. The first portion is rotationally connected to the second portion. The first portion can be locked in relation to the second portion by a locking device. The locking device includes a locking member having a locking portion. A holster is connected to the rotational locking device. The rotational locking piece locks the holster in a many positions and the locking portion prevents the first portion from rotating when it is inserted in a locking groove formed on the first portion.

Another embodiment includes a holster system including a locking device. The locking device includes a first portion, a second portion, and a locking portion. A holster is connected to the locking device. A belt connecting device is connected to the locking device. The locking device locks the holster in many angled positions in relation to the belt connecting device. The locking portion prevents the first portion from rotating when the locking portion is disposed within one of many locking portions formed on the first portion.

Yet another embodiment includes a method including releasing a positional lock of a holster device, rotating the holster device to a desired angle in relation to a belt coupling device (the belt coupling device is rotationally coupled to the holster device), and inserting an engaging portion into a locking portion of the positional lock when the holster device is at the desired angle. When the engaging portion of positional lock is inserted into the locking portion the holster device is prevented from rotating without releasing the positional lock.

BRIEF DESCRIPTION OF THE DRAWINGS

The embodiments discussed herein generally relate to a multi-position locking utility holder. Referring to the figures, exemplary embodiments will now be described. The exemplary embodiments are provided to illustrate the embodiments and should not be construed as limiting the scope of the embodiments.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

DETAILED DESCRIPTION OF THE INVENTION

The invention generally relates to a multi-position locking utility holder. Referring to the figures, exemplary embodiments of the invention will now be described. The exemplary embodiments are provided to illustrate the invention and should not be construed as limiting the scope of the invention.

Figure 1A:
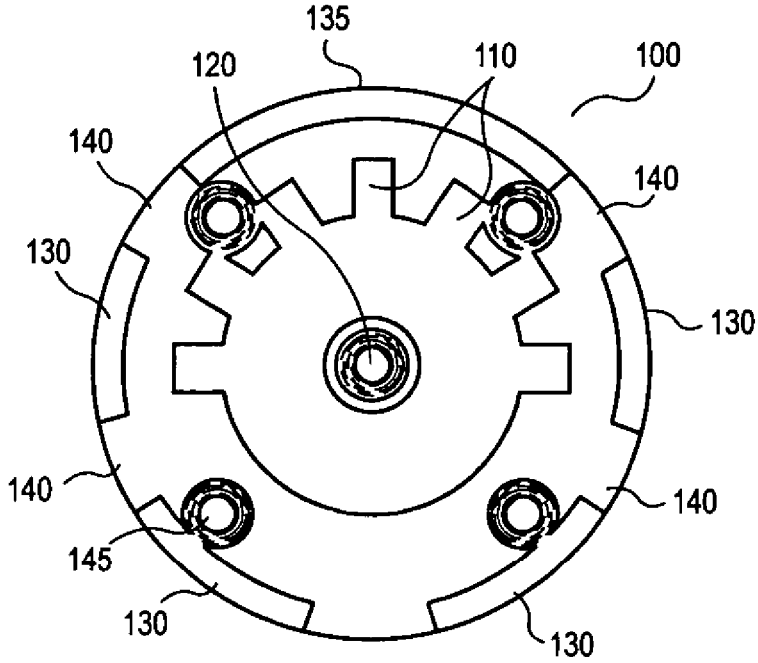
FIG. 1A illustrates a first portion of an embodiment of a holster locking apparatus.

FIG. 1A illustrates a first portion of an embodiment of a holster locking apparatus. In one embodiment first portion 100 of a rotational locking device includes a plurality of locking grooves/portions 110. One embodiment has seven (7) locking grooves. Other embodiments have differing numbers of locking grooves 110, such as five (5), six (6), eight (8), etc. In one embodiment first portion 100 is made of hardened plastic. In other embodiments, first portion 100 is made of metals, metal alloys, composite plastics, carbon fiber, hi grade thermal-plastic, leather, etc.

In one embodiment first portion 100 includes center through-hole 120. In this embodiment, an attachment means, such as a screw, a nut and bolt, a rivet, etc., is disposed through center through-hole 120 to couple second portion 200 (illustrated in FIG. 2). In one embodiment, a plurality of holster coupling through-holes 145 are included on first portion 100. In one embodiment four (4) coupling through-holes 145 are included on first portion 100. In other embodiments, any appropriate number of coupling through-holes can be included on first portion 100, such as five (5), six (6), etc. In yet another embodiment, first portion 100 does not include coupling through-holes 145, but instead includes other holster coupling means, such as first portion 100 is made part of a holster, first portion 100 has protruding holes where rivets, screws, etc. can be attached, etc.

Figure 2:
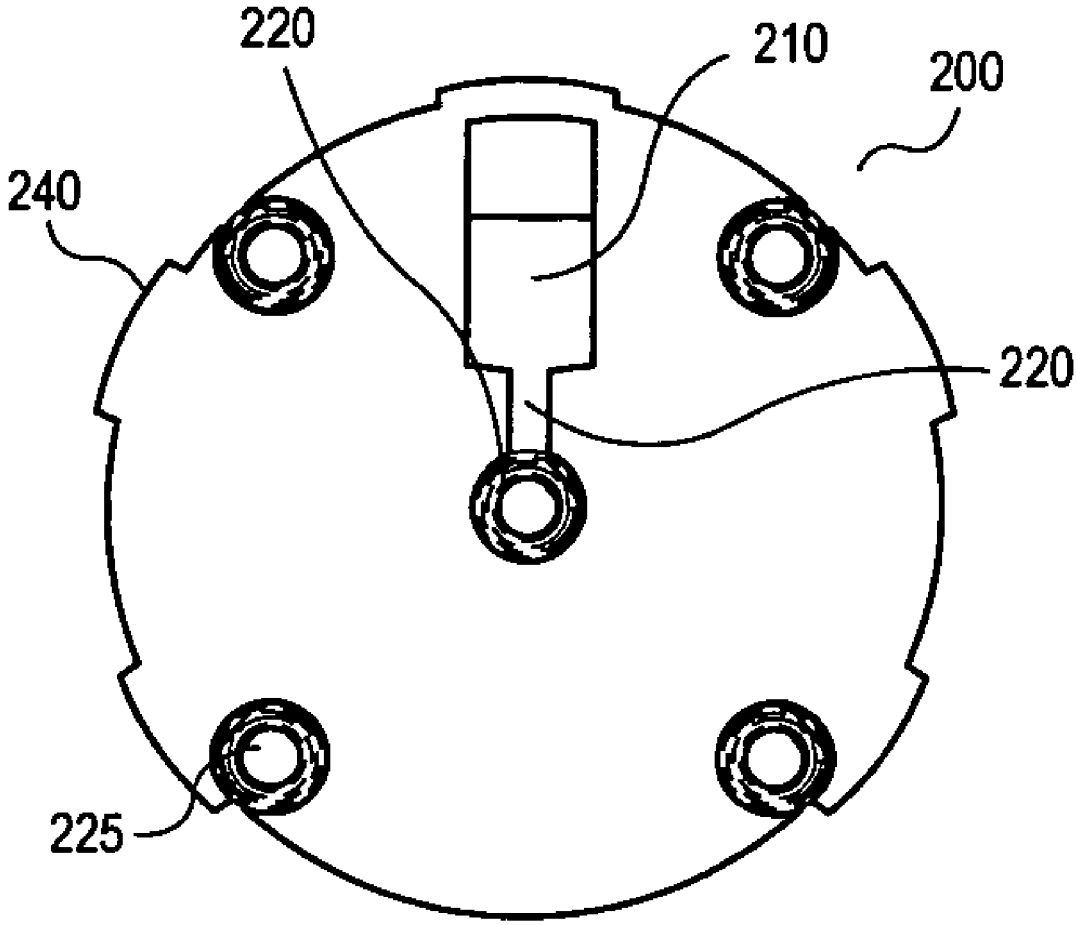
FIG. 2 illustrates a second portion of an embodiment of a holster locking apparatus.

In one embodiment groove/portion 140 provides complimentary fit of extension portion 240 (illustrated in FIG. 2). In this embodiment portion 130 provides complimentary fit between adjacent extension portions 240 (illustrated in FIG. 2). Top portion 135 is illustrated for positional reference.

In one embodiment locking grooves/portions 110 are separated from one another a predetermined distance, such as ⅛ inch, ¼ inch, etc. In one embodiment locking grooves/portions 110 are arranged at predetermined angles in relation to center through-hole 120, such as −90°, −60°, −30°, 0°, 30°, 60, 90°, etc. It should be noted that other configurations of different angled arrangements for locking grooves/portions 110 can be used, such as 10° spacing, 20° spacing, 45° spacing, etc.

Figure 1B:
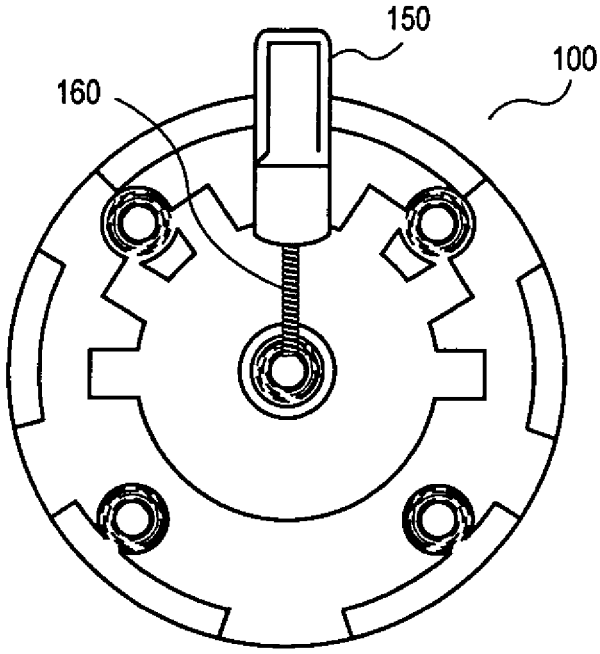
FIG. 1B illustrates a first portion of an embodiment of a holster locking apparatus with a releasing/engaging element.

FIG. 1B illustrates first portion 100 including means for positionally locking a holster at a predetermined angle. In one embodiment, the means for locking is locking device 150 (illustrated by itself in FIG. 4). In one embodiment, locking device 150 is coupled to spring 160. In one embodiment spring 160 is coupled to locking device 150 through a through-hole centered on a bottom portion of locking device 150. The top portion of locking device 150 acts as a button to compress spring 160 when depressed downward. When force is removed from the top of locking device 150, spring 160 returns to an uncompressed state moving locking device 150 back to its original height.

FIG. 2 illustrates second portion 200 of an embodiment of a holster locking apparatus. Second portion 200 is complementary coupled to first portion 100. In one embodiment first portion 100 and second portion 200 are circular shaped. It should be noted that in other embodiments the external shape of first portion 100 and second portion 200 is non-circular shapes (e.g., polygonal), while the internal portion including locking grooves/portions 110 is circular shaped to allow easy rotation of first portion 100 in relation to second portion 200. In one embodiment second portion 200 is made of hardened plastic. In other embodiments, second portion 200 is made of metals, metal alloys, composite plastics, carbon fiber, hi grade thermal-plastic, leather, etc.

In one embodiment second portion 200 includes coupling through-holes 225. In this embodiment coupling through-holes 225 are used to couple second portion 200 to a belt coupling device 510 (illustrated in FIG. 5). In one embodiment, second portion 200 includes four (4) coupling through-holes 225. It should be noted that other embodiments can include other number of coupling through-holes 225, such as five (5), six (6), etc. In other embodiments, second portion does not include coupling through-holes 225, but instead has other belt device coupling means, such as protruding portions with holes where rivets, screws, etc. can be attached, etc.

Second portion 200 includes locking device groove/portion 210. In this embodiment locking device 150 is disposed within locking device groove/portion 210. In this embodiment, spring 160 has a portion of its length disposed in groove/portion 220. Locking device 150 is slidably coupled to second portion 200 so it slides up and down within locking device groove/portion 210.

Figure 3:
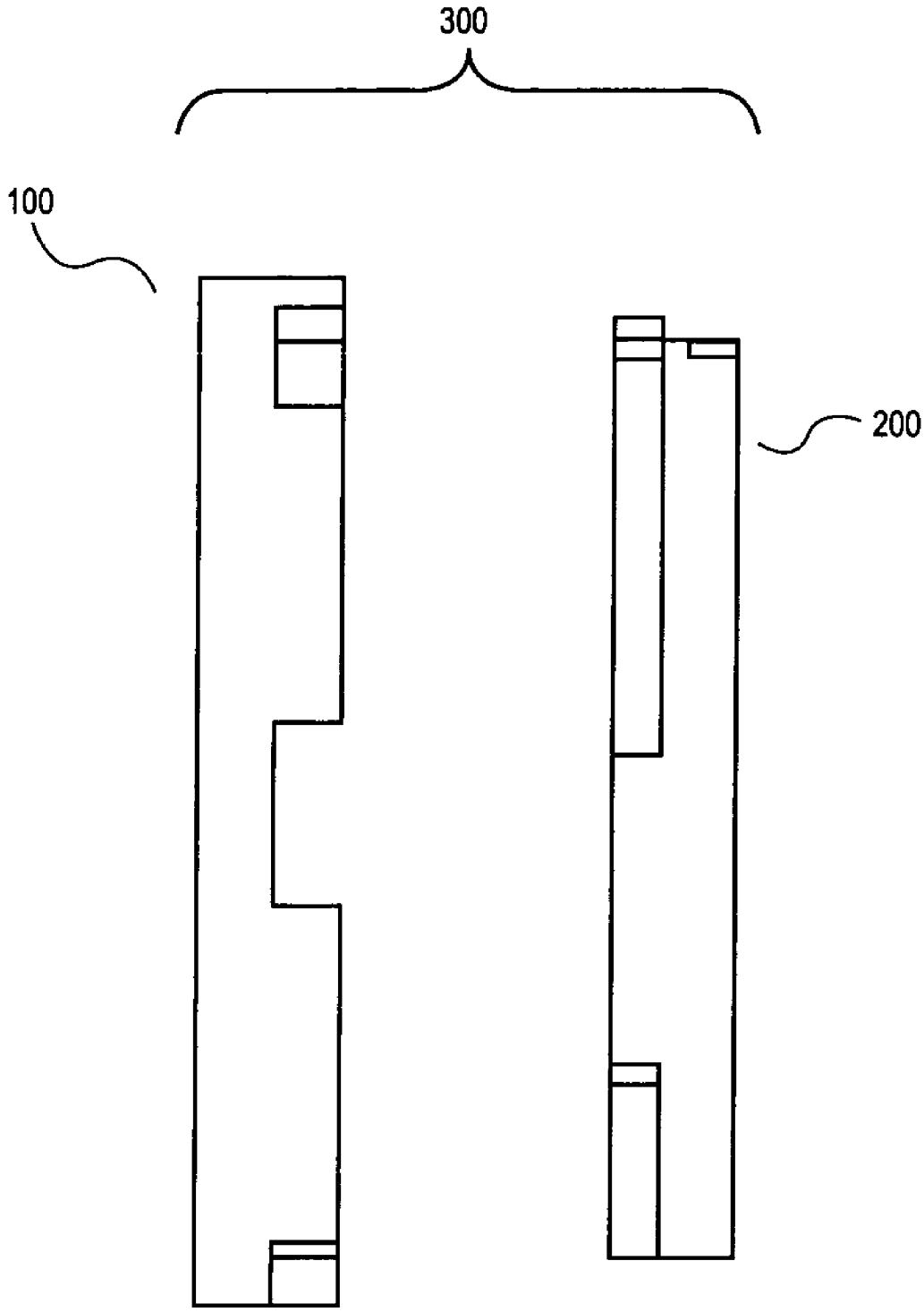
FIG. 3 illustrates a side view of the first portion and the second portion of a holster locking apparatus.

FIG. 3 illustrates a side view of first portion 100 and second portion 200 next to one another. First portion 100 and second portion 200 comprise locking device 300. As illustrated second portion 200 is complementary fitted to be coupled to first portion 100. In one embodiment, second portion 200 is coupled to a belt coupling device and first portion 100 is coupled to a holster, such as a holster for batons (e.g., expandable batons). Second portion 200 remains stationary when coupled to a belt (e.g., a utility belt for a police officer) and first portion 100 is rotatably locked in a desired position in relation to second portion 200.

Figure 4:
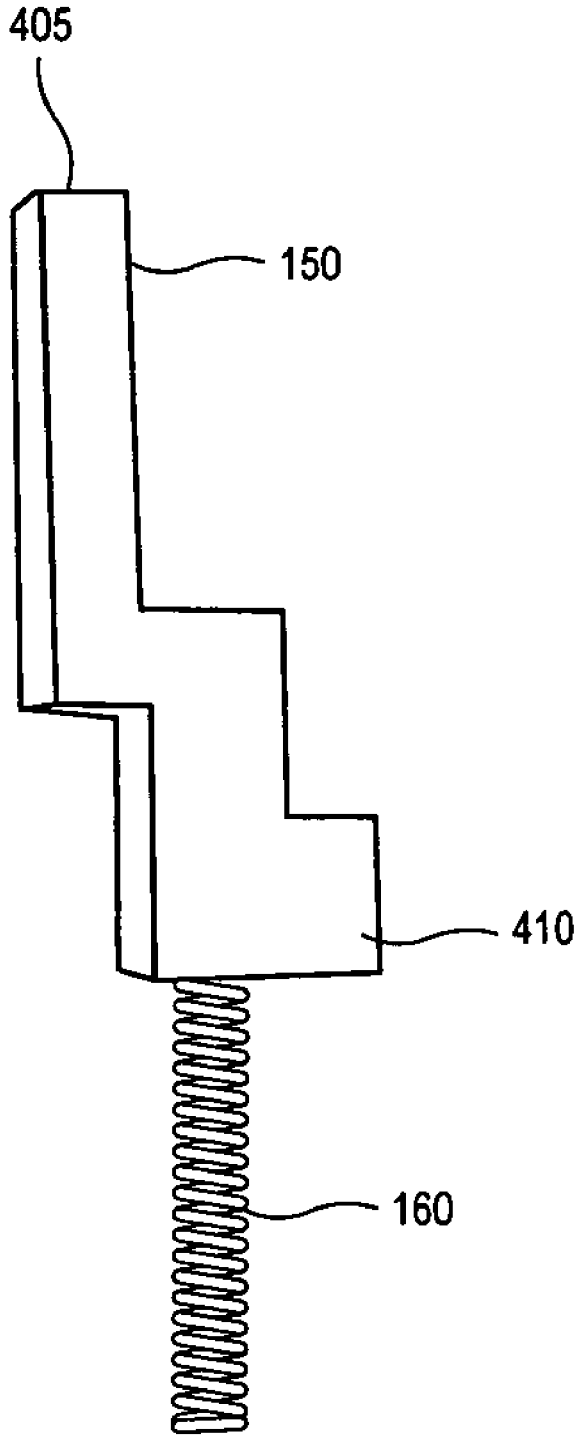
FIG. 4 illustrates a side view of the releasing/engaging element.

FIG. 4 illustrates means for positionally locking a holster for an embodiment of a holster locking apparatus. In one embodiment, the means for positionally locking a holster includes engaging/releasing device 150. Locking device includes top portion 405, spring 160 and engagement/locking portion 410. In one embodiment, when top portion 405 is depressed (i.e., compresses spring 160 to move engaging/releasing device 150 lower in locking device groove/portion 210), engaging/locking portion 410 is moved out of locking groove/portion 110. When engaging/locking portion 410 is free of locking groove/portion 110, first portion 100 is free to rotate. When first portion is rotated to a desired locking groove/portion 110, top portion 405 is released moving engaging/releasing device 150 back to its original position in locking device groove/portion 210. Engaging/locking portion 410 is then also moved (i.e., inserted) into a locking groove/portion 110, thus inserting engaging/locking portion 410 within one of the locking groove/portions 110. This results in first portion 100 being locked in position. When engaging/locking portion 410 is inserted within a locking groove/portion 110, first portion 100 cannot be moved/rotated with force until engaging/locking portion 410 is disengaged.

It should be noted that other embodiments can use other locking means. In one embodiment, instead of locking groove/portions 110, through-holes are used with a spring loaded pin device (not illustrated). In this embodiment, the spring loaded pin is pulled by a user to extend the pin out of a through-hole. When the pin is removed from one of the plurality of through-holes, a holster can be rotated. When the desired angle of the holster is reached, the spring loaded pin is released and returns to be disposed in the particular through-hole at the desired angle. Another embodiment includes a spring loaded lock ball that is depressed and then released to fit in a through-hole. When released, the spring ball protrudes within the through-hole locking a holster in place. Spring loaded lock balls are commonly used in devices, such as leg extensions in portable shelters, etc. Once the spring loaded lock ball is pressed, first portion 100 can be rotated until the lock ball protrudes through the next through-hole. This can be repeated until the desired rotational angle is reached. Therefore, it can be seen that other engaged locking means that positively lock first portion 100 when the locking means is engaged so that first portion 100 is immovable until disengaged can be implemented without moving away from the scope of the invention.

Figure 5A:
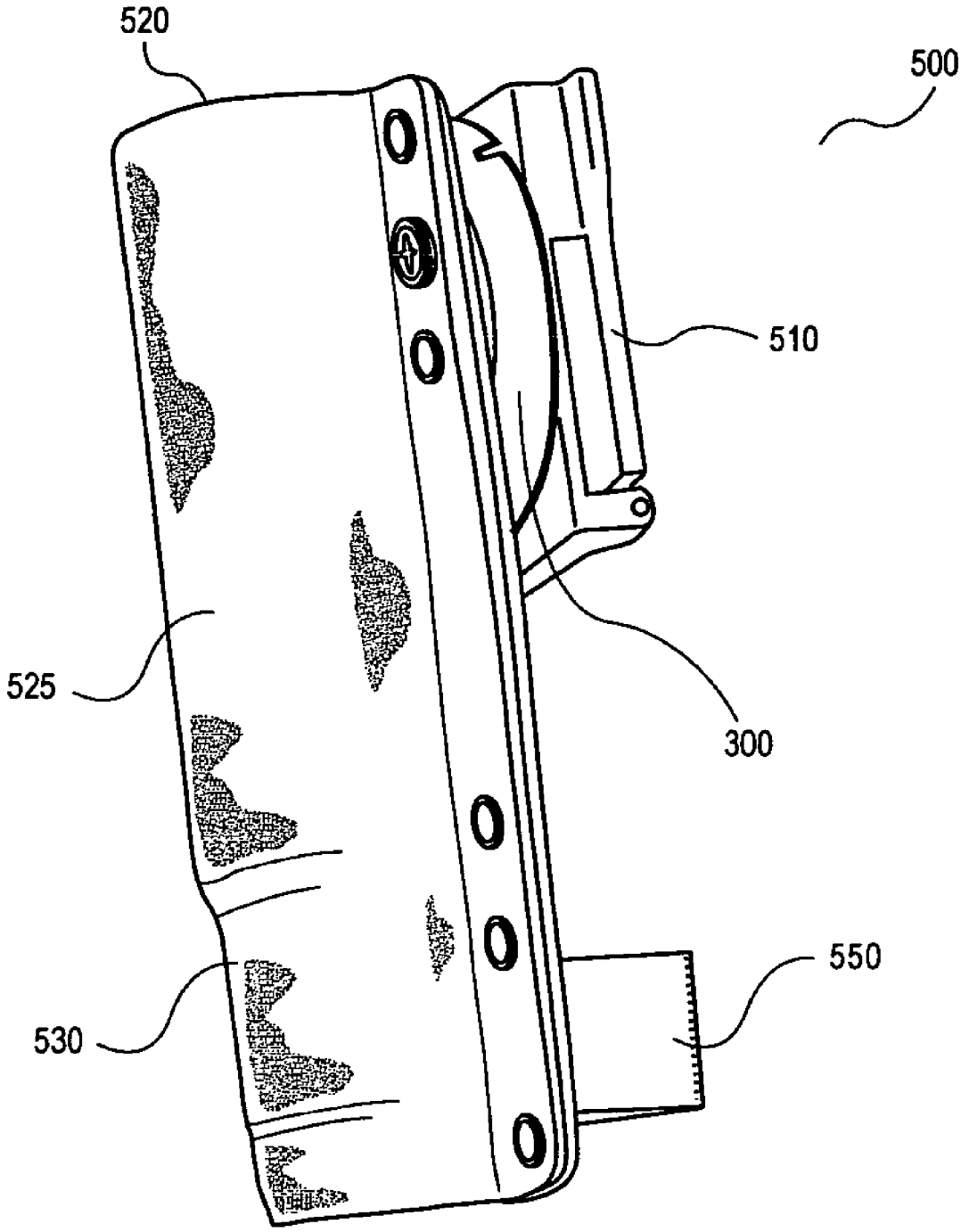
FIG. 5A illustrates a side view embodiment of a multi-positional locking holster.

FIG. 5A illustrates an embodiment for a positional locking holster. As illustrated, positional locking holster 500 includes holster 520 coupled to rotational locking device 300. In one embodiment, holster 520 includes first cylindrical portion 525 and second cylindrical portion 530. In one embodiment, second cylindrical portion 530 is tapered from first cylindrical portion 525 (i.e., narrower diameter). In one embodiment holster 520 has suitable dimensions to accommodate typical expanding batons having lengths, such as 26 inches, 29 inches, etc. and of a diameter, such as 1¼ inches, 1½ inches, etc.

In one embodiment positional locking holster 500 includes belt coupling portion 510, where belt coupling portion 510 is coupled to (rotational) locking device 300 (via second portion 200). Locking device 300 locks holster 520 in any of a predetermined angled position in relation to belt coupling device 510. In one embodiment, belt coupling device 510 is an adjustable belt clip including a hinge to ease opening and closing of belt clip 510 (for coupling to a belt and removing from a belt). In one embodiment, support 550 is coupled to back portion 540 (see FIG. 5B). In this embodiment, since an elongated baton creates a higher center of gravity when holstered in positional locking holster 500, support 550 relieves added pressure to locking device 300. In one embodiment support 550 is made of hardened plastic. In other embodiments, support 550 is made of metals, metal alloys, composite plastics, carbon fiber, hi grade thermal-plastic, leather, etc.

Figure 5B:
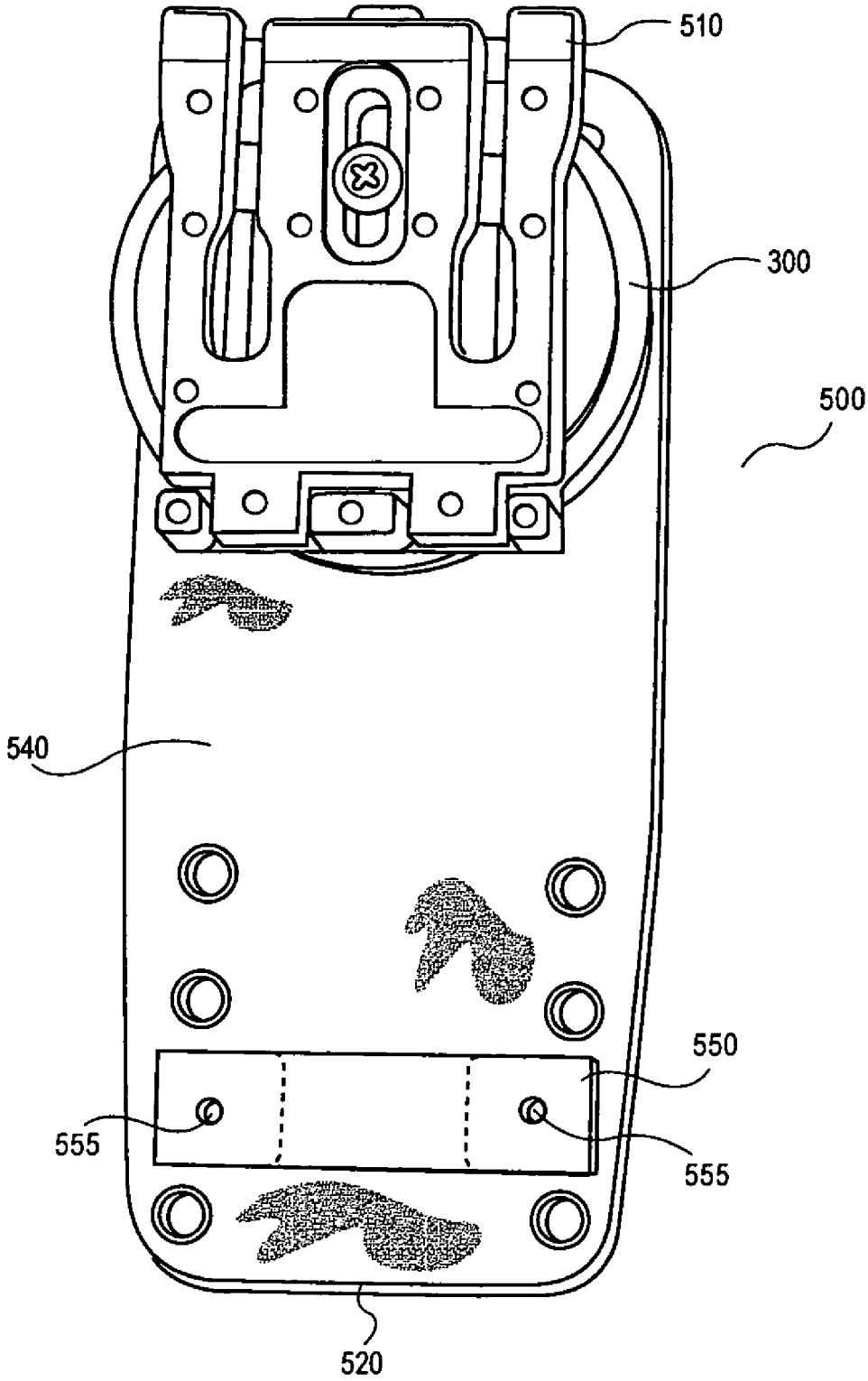
FIG. 5B illustrates a rear view embodiment of a multi-positional locking holster.

FIG. 5B illustrates a rear view of positional locking holster 500. As illustrated, holster 520 includes back portion 540. In one embodiment holster 520 is made with back portion 540 and first and second cylindrical portions 525 and 530 (which are formed together as a front portion). Therefore, holster 520 is made of two separate pieces of material. In this embodiment, coupling pieces 550 couple both portions of holster 520 together. In one embodiment, coupling pieces are rivets. In other embodiments, different coupling means can be used, such as screws, nuts and bolts, etc. In another embodiment, holster 520 has back portion 540 and first and second cylindrical portions 525 and 530 heat welded together. In yet another embodiment, holster 520 is molded to form one single piece. In one embodiment, support 550 includes access through-holes 555 for mounting to back portion 540. In this embodiment, an attachment means, such as a screw, a nut and bolt, a rivet, etc., is disposed through access through-holes 555 to couple support 550 to back portion 540.

Figure 6B:
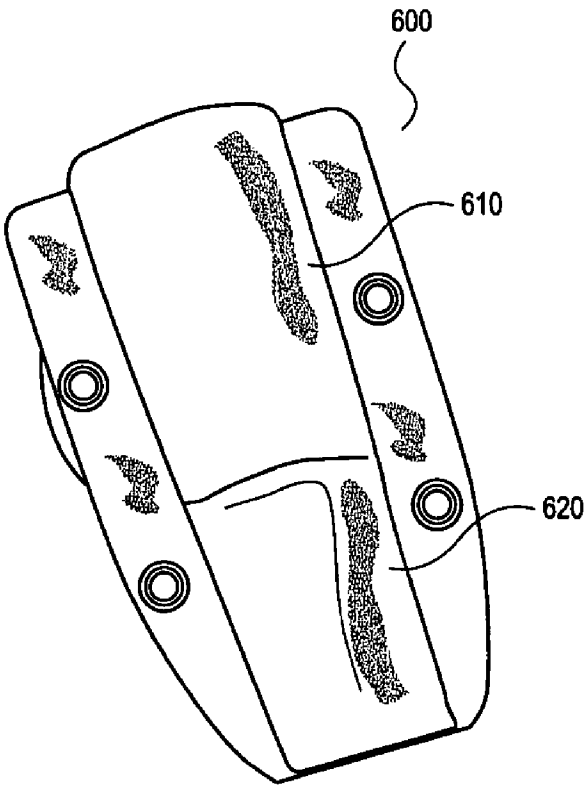
FIG. 6B illustrates a front angled view of another embodiment of a multi-positional locking holster.
Figure 6A:
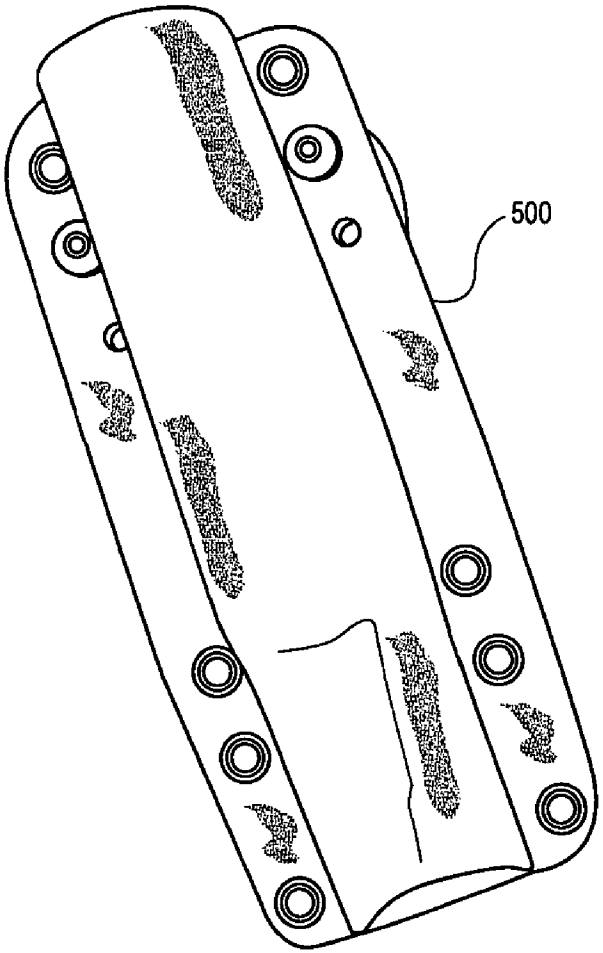
FIG. 6A illustrates a front angled view of an embodiment of a multi-positional locking holster.

FIGS. 6A and 6B illustrate different sized holsters. As illustrated positional locking holster 500 is larger than positional locking holster 600 (including first cylindrical portion 610 and second cylindrical portion 620, which is tapered from first cylindrical portion 610). Both positional locking holster 500 and positional locking holster 600 are coupled to locking devices 300 and belt coupling devices 510. In one embodiment, positional locking holster 600 is of suitable dimensions to accommodate typical expanding batons having lengths, such as 21 inches, 24 inches, etc. and of a diameter, such as 1¼ inches, 1½ inches, etc. Similarly to positional locking holster 500, positional locking holster 600 can be locked into a desired position from depressing engaging/releasing device 150 and rotating positional locking holster 600 via first portion 100 and then disengaging engaging/releasing device 150, which locks first portion 100 at the desired angle in relation to second portion 200.

It should be noted that since locking device 300 can rotate and lock in forward and reverse directions, holsters for left handed as well as right handed persons can be coupled to the same locking device 300. Also, since locking device 300 locks a holster in a desired position, an officer or user will know exactly where the baton (e.g., expandable baton) is. This prevents an officer or user having to reach for the baton, only to find the tool had moved.

Figure 7:
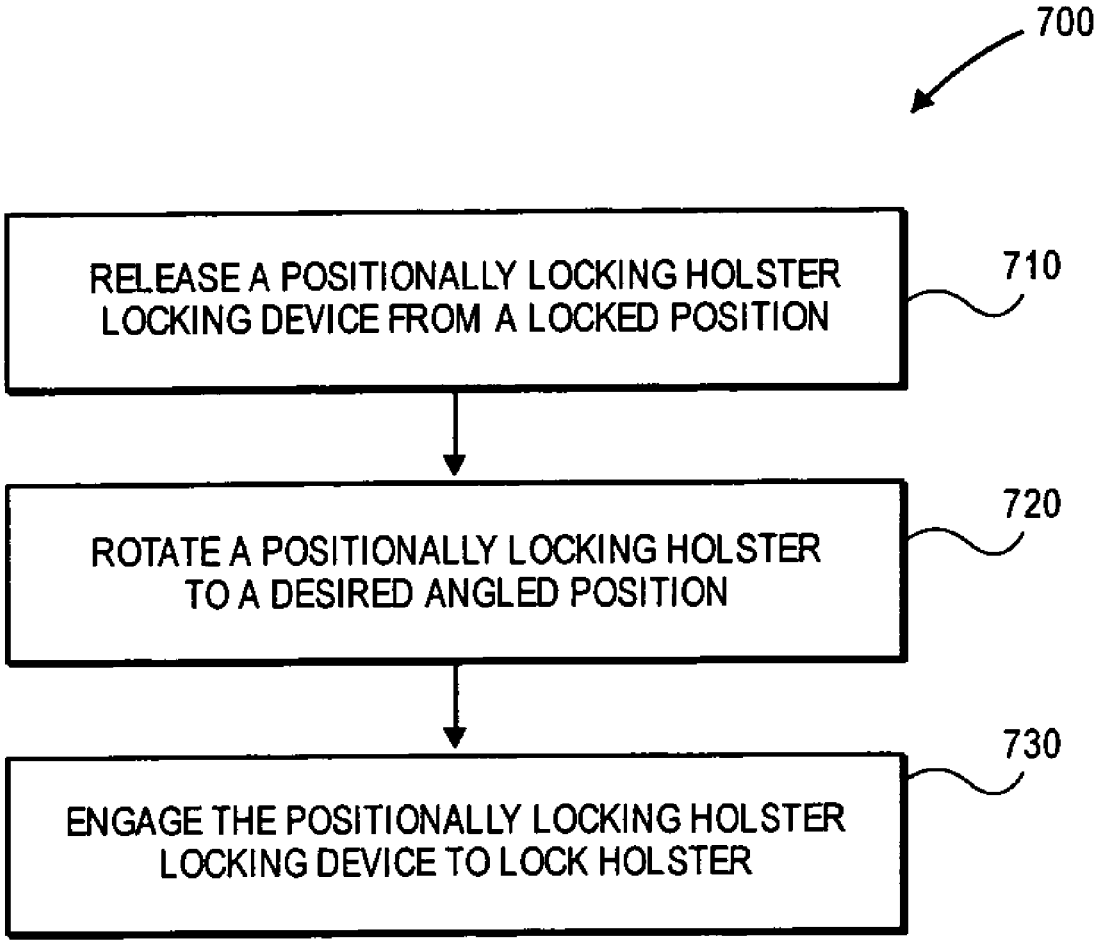
FIG. 7 illustrates a block diagram of a process for using an embodiment of a multi-positional locking holster.

FIG. 7 illustrates a block diagram of a process for using an embodiment of a positional locking holster, such as positional locking holsters 500 and 600. Process 700 begins with block 710, where a user of a positional locking holster releases a locking device from a locked position. In one embodiment, the locking device is locking device 300 and the user releases locking device 300 from a locked position by depressing engaging/releasing device 150. In this embodiment, engaging/releasing device 150 is moved from a first position to a second position. The first position being a normal position, and the second position being a depressed position.

Process 700 continues with block 720. In block 720 the positional locking holster is rotated to a desired angle in relation to a belt coupling device, such as belt coupling device 510. Since engaging/releasing device 150 is depressed, the positional locking holster is free to rotate in forward and reverse rotations.

Process 700 continues with block 730. In block 730, once the positional locking holster is rotated to the desired position, the locking device is inserted to lock the positional locking holster in place. In one embodiment, engaging/releasing device 150 is released from the depressed state. This returns engaging/releasing 150 to its original height and inserts engaging/locking portion 410 in a locking groove/portion 110. Therefore, the positional locking holster is prevented from rotating without releasing the locking device.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An apparatus comprising:

a rotational locking device, the rotational locking device including:

a first portion having a substantially planar outer surface and an inner surface substantially parallel to the outer surface, a second portion having a substantially planar outer surface and an inner surface substantially parallel to the outer surface, the first portion is rotationally coupled to the second portion and the inner surface of the first portion interfaces with the inner surface of the second portion, means for locking the first portion in relation to the second portion, the means for locking including a locking device having an engaging portion and a top portion, the engaging portion comprising a substantially L shaped configuration laterally offset from the top portion such that the engaging portion is positioned between the inner surface of the first portion and the inner surface of the second portion and the top portion extends beyond the inner surfaces of the first portion and the second portion; and a holster coupled to the rotational locking device;

wherein the rotational locking device locks the holster in a plurality of positions and the engaging portion prevents the first portion from rotating when disposed within one of a plurality of locking grooves formed on the first portion.

2. The apparatus of claim 1, wherein the locking device further comprises a bottom portion and a spring coupled to the bottom portion.

3. The apparatus of claim 1, wherein the plurality of locking grooves are separated from one another a predetermined distance, and the plurality of locking grooves are arranged at predetermined angles in relation to a center of the first portion.

4. The apparatus of claim 1, the second portion comprising:

a first groove and a second groove, the first groove slidably coupled to the means for locking.

5. The apparatus of claim 1, further comprising:

a belt coupling portion, wherein the belt coupling portion is coupled to the rotational locking device.

6. The apparatus of claim 1, wherein when the engaging member is disposed within one of the locking grooves formed on the first portion, the first portion cannot rotate unless a user applies radial force on the top portion of the locking member.

7. The apparatus of claim 1, wherein the holster is an expandable baton holster comprising a first cylindrical portion and a second cylindrical portion, wherein the second cylindrical portion is tapered.

8. The apparatus of claim 1, wherein each of the plurality of grooves comprise an open end and a closed end opposite the open end.

9. A holster system comprising:

a locking device, the locking device including a first portion having an inner surface and an outer surface, a second portion having an inner surface contacting the inner surface of the first portion and an outer surface, and a locking member, the locking member comprising an engaging portion positioned between the inner surface of the first portion and the inner surface of the second portion and a top portion extending above the first portion and the second portion, the engaging portion comprising a substantially L shaped configuration laterally offset from the top portion of the locking member;

a holster coupled to the locking device;

a belt coupling device coupled to the locking device;

wherein the locking device locks the holster in a plurality of angled positions in relation to the belt coupling device, and the engaging portion completely prevents the first portion from rotating when the engaging portion is disposed within one of a plurality of grooves extending from a center portion of the first portion.

10. A holster system comprising:

a locking device, the locking device including a first portion, a second portion, and a locking member, the locking member having an engaging portion comprising a substantially L shaped configuration laterally offset from a top portion of the locking member, the locking member movable in a radial direction relative to the first portion upon the application of a force by a user in the radial direction;

a holster coupled to the locking device;

a belt coupling device coupled to the locking device;

wherein the locking device locks the holster in a plurality of angled positions in relation to the belt coupling device; the locking member having an engaging portion movable in the radial direction; the engaging portion prevents the first portion from rotating when the engaging portion is inserted in the radial direction within one of a plurality of grooves extending from a center portion of the first portion.

11. The holster system of claim 10, wherein the first portion is rotationally coupled to the second portion.

12. The holster system of claim 10, wherein the plurality of grooves are separated from one another a predetermined distance, and the plurality of grooves are arranged at predetermined angles in relation to the center of the first portion.

13. The holster system of claim 10, wherein the holster is an expandable baton holster.

14. The holster system of claim 13, the expandable baton holster comprising a first cylindrical portion and a second cylindrical portion, wherein the second cylindrical portion is tapered.

15. The holster system of claim 10, wherein the locking member has a top portion, which is accessible from above the first portion and the second portion.

* * * * *